United States Patent [19]

Filter et al.

[11] Patent Number: 4,516,823

[45] Date of Patent: May 14, 1985

[54] LOADBREAK BUSHING AND SNUFFER/CONTACT ASSEMBLY THEREFOR

[76] Inventors: Reinhard Filter, 14 Charles St., Georgetown, Ontario, Canada, L7G 2Z2; Donald J. Stonkus, 271 Lakeview Ave., Burlington, Ontario, Canada, L7N 1Y7

[21] Appl. No.: 559,095

[22] Filed: Dec. 7, 1983

[30] Foreign Application Priority Data

Sep. 19, 1983 [CA] Canada ..... 436950

[51] Int. Cl.[3] ..... H01R 13/53

[52] U.S. Cl. ..... 339/111

[58] Field of Search ..... 339/111, 143 C; 174/142, 144, 145

[56] References Cited

U.S. PATENT DOCUMENTS

| | | | |
|---|---|---|---|
| 3,713,077 | 1/1973 | Leonard | 339/111 |
| 4,113,339 | 9/1978 | Eley | 339/111 |
| 4,116,515 | 9/1978 | Spicer | 339/111 X |
| 4,350,406 | 9/1982 | Goldbach | 339/111 X |

*Primary Examiner*—Eugene F. Desmond

*Attorney, Agent, or Firm*—Ridout & Maybee

[57] ABSTRACT

In a gas-actuated loadbreak bushing having an axially displaceable snuffer/contact assembly, the assembly is provided with radial lockout means in the form of gas-actuated radial pistons which, when actuated in response to a fault closure, interfere with an end abutment lip of the bushing housing so as to prevent resetting of the bushing thereby indicating to the lineman a need to replace the bushing and so eliminating the risk of having the bushing subjected to repeated fault closure.

14 Claims, 5 Drawing Figures

LOADBREAK BUSHING AND SNUFFER/CONTACT ASSEMBLY THEREFOR

FIELD OF THE INVENTION

This invention relates to loadbreak bushings, such as, for example, gas-actuated loadbreak bushings for use in high voltage electrical equipment, and to snuffer/contact assemblies therefor.

BACKGROUND OF THE INVENTION

Dead-front underground primary distribution systems are practical, largely because of the widespread use of separable insulated loadbreak connectors by which high voltage cable may be connected to electrical equipment such as transformers. An important part of the separable loadbreak connector system is a loadbreak bushing. A typical loadbreak bushing comprises an insulating housing having an axially extending bore which is closed at one end by a terminal contact, the latter being adapted for connection to a high voltage terminal of an electrical equipment. A snuffer/contact assembly is supported within the bore for axial movement therealong, the assembly comprising a bore contact with an insulating sleeve extending therefrom. The sleeve contains an ablative material which, if the lineman attempts to connect a cable terminator under a fault condition, responds to prestrike arcing by generating an arc extinguishing gas within the sleeve. The effect of the gas generated is to extinguish the arc and also, in the case of a gas-actuated loadbreak bushing, to displace the snuffer/contact assembly along the bore. The snuffer/contact assembly is constructed as a composite piston and is displaced by the gas pressure from a first, seated position to a second position at which it makes contact with the cable by a loadbreak elbow.

In the past, loadbreak bushings were of rugged construction capable of withstanding numerous fault closures. Modern designs cannot safely withstand repeated fault closures, however, and present a serious hazard to a lineman who attempts to perform a subsequent fault closure.

SUMMARY OF THE INVENTION

The present invention provides a loadbreak bushing which cannot easily be reset after a fault closure and which therefore provides a clear indication to the lineman that the entire bushing must be replaced. This is achieved by providing on the snuffer/contact assembly a gas-actuated radial lockout device which, in response to the generation of gas pressure under a fault condition, engages with abutment means on the bushing housing so as to prevent resetting to the normal position.

Thus, a loadbreak bushing according to the invention comprises an insulating housing having an axially extending bore therein, terminal contact means closing one end of the bore, the other end of the bore being open to receive a terminator probe, the housing having an end portion providing radial abutment means adjacent said open end of the bore, a snuffer/contact assembly supported with the bore for reciprocal movement therealong, the snuffer/contact assembly being axially displaceable from a first, seated position to a second position in response to prestrike arcing under fault conditions, the snuffer/contact assembly comprising a tubular insulating sleeve having an inner end portion carrying a bore contact and an outer end portion cooperating with said end portion of the housing, electrically conductive means providing a current path between said bore contact and the terminal contact means, and gas-actuated radial lockout means carried by said outer end portion of the sleeve, said lockout means being responsive to the generation of gas pressure within the bore and engageable with said abutment means of the housing end position when the snuffer/contact assembly is in the second position thereby to prevent return of the snuffer/contact assembly to the first position.

The snuffer/contact assembly may be assembled and sold as a separate unit for use as a replacement part for an existing bushing.

Preferably the radial lockout device comprises one or more gas-actuated pistons retained in radial bores of the insulating sleeve, the piston or pistons being responsive to the generation of gas under a fault condition and positioned so as to interfere with an annular abutment lip at the end of the housing bore when the contact assembly has been displaced to its second position.

BRIEF DESCRIPTION OF THE DRAWINGS

In order that the invention may be readily understood, one embodiment thereof will now be described by way of example with reference to the accompanying drawings, in which.

DESCRIPTION OF THE PREFERRED EMBODIMENTS

Figure 1:
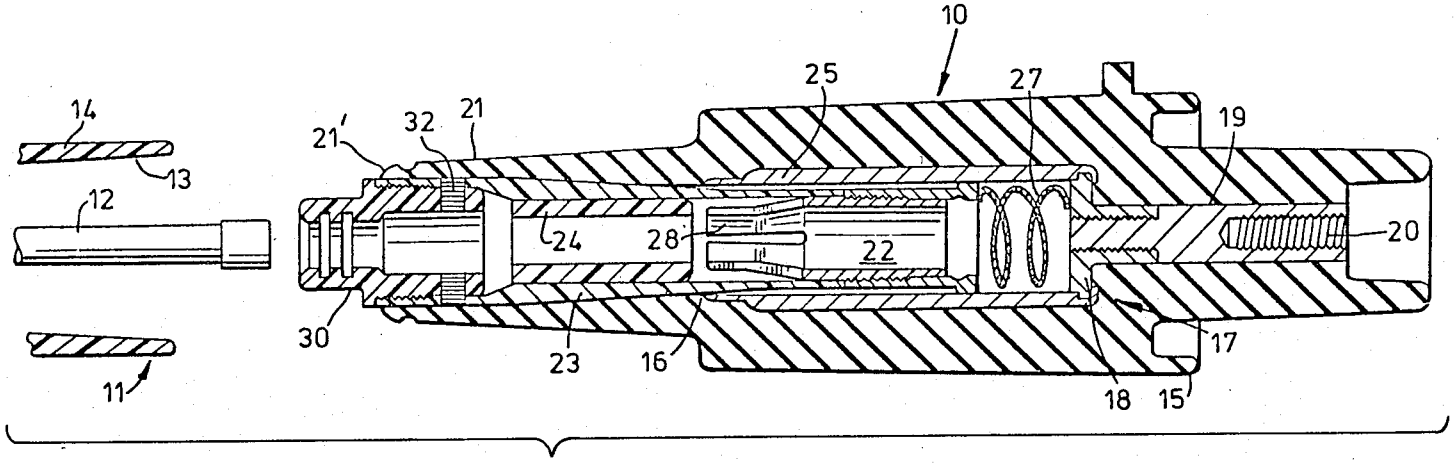
FIG. 1 is a longitudinal sectional view of a gas-actuated loadbreak bushing according to the invention, the snuffer/contact assembly being set in its seated position.

Although the following description relates to a typical gas-actuated loadbreak bushing, it is to be understood that the invention is applicable to other types of loadbreak bushing in which the snuffer/contact assembly is axially displaceable in response to prestrike arcing under fault conditions, for example the type in which the snuffer/contact assembly is displaced by electromagnetic means rather than by gas pressure.

Referring to the drawings, the high voltage bushing 10 is adapted to be used with an elbow terminator 11 for connecting a high voltage cable to a terminal of an electrical equipment such as, for example, a transformer. The terminator 11 has a contact probe 12 positioned coaxially in a tapered recess 13 of the terminator casing 14.

The bushing 10 comprises an elongated housing 15 of elastomeric material having an axially extending bore 16. The bore 16 is closed at one end by a terminal contact 17 in the form of a conductive disc 18 having an axially extending stem 19. The stem 19 has a threaded bore 20 at its distal end for connection to a threaded stud or terminal of the equipment. The other end of the bore 16 is open, and the housing 15 has a tapered end portion 21 to receive the terminator casing 14, the end portion 21 terminating in an annular end abutment lip 21' defining the open end of the bore 16.

Figure 2:
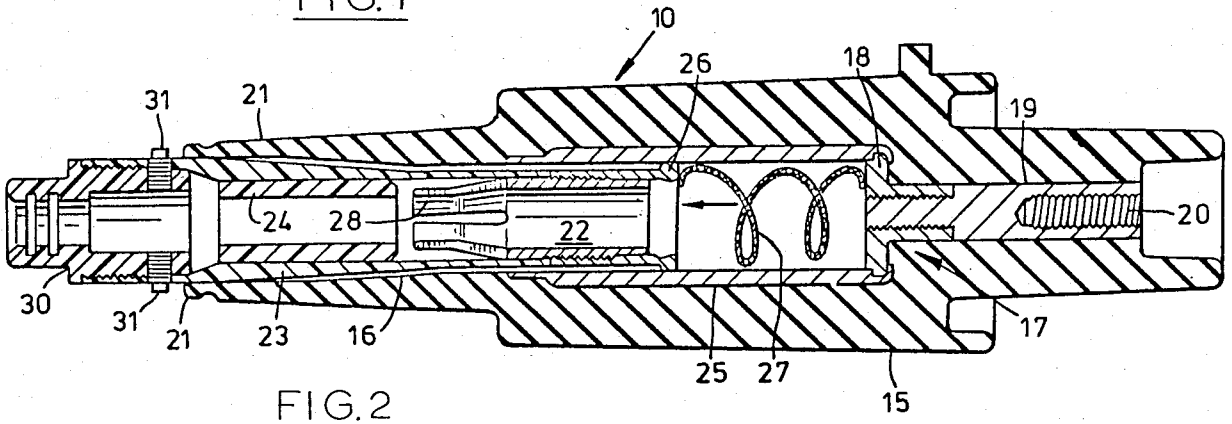
FIG. 2 is a view corresponding to FIG. 1 but with the snuffer/contact assembly in the fault closure position.

Supported within the bore 16 is a snuffer/contact assembly comprising a bore contact 22, a tubular sleeve 23 of insulating material such as phenolic resin extending therefrom, the sleeve 23 having an outer end portion which cooperates with the end portion 21 of the housing, and a sleeve of ablative material 24 located within the insulative sleeve 23. The snuffer/contact assembly is a sliding fit within the bore and is displaceable therealong from a first, seated position as shown in FIG. 1 to a second, fault closure position as shown in FIG. 2. Electrical connection between the bore contact 22 and the terminal contact 18 is provided by means of a conductive cylinder 25 which lines the bore 16 adjacent its closed end, the bore contact 22 having an end flange 26 which slides in conductive relation to the cylinder 25. The electrical connection is further maintained by a coiled flexible conductor 27 connected between the flanged end of the bore contact and the disc 18.

The bore contact is constructed so as to provide a tulip contact 28 at one end to receive the terminator probe 12, and an annular end face 29 against which gas pressure is exerted in the event of a fault closure so as to displace the contact assembly from its normal position to its second or fault closure position. Thus, if a lineman attempts to connect the elbow terminator to the bushing under a fault condition, a prestrike arc from the terminator probe to the tulip contact 28 will result in the generation of gas by the material of the ablative sleeve 24. This gas will serve to extinguish the arc and, in addition, will exert a thrust on the inner face of the bore contact 22 as to displace the snuffer/contact assembly from its seated to its fault closure position. Resetting of the assembly is prevented by a lockout device which will now be described, details of the lockout device being shown in FIGS. 3–5.

Figure 3:
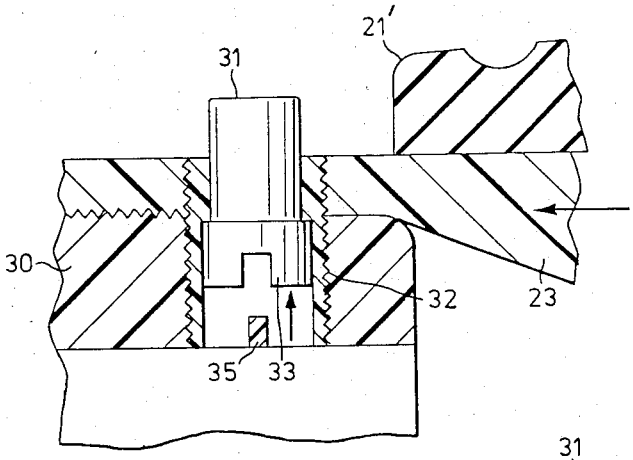
FIG. 3 is a sectional view showing a detail of the lockout device of the invention.
Figure 5:
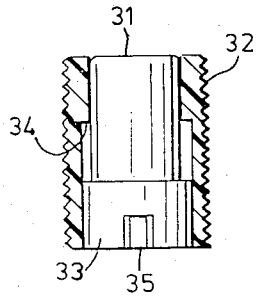
FIG. 5 is a sectional view showing the lockout elements assembled.
Figure 4:
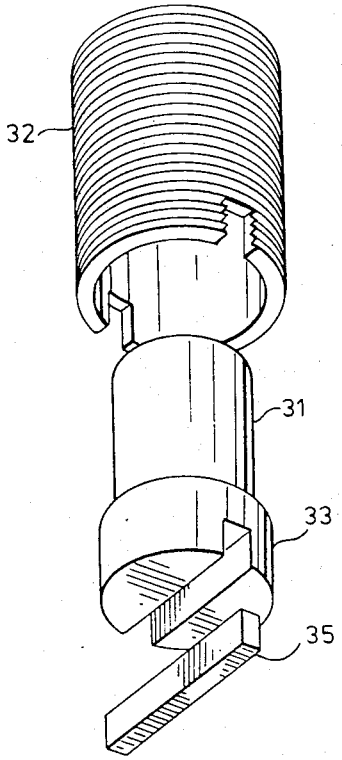
FIG. 4 is an exploded view showing the elements of the lockout device.

A tubular insert 30 of insulating material is threaded into the open end of the tubular sleeve 23. The sleeve 23 is formed with at least one, and in the present example two radial bores adjacent its open end, the insert 30 also being formed with a corresponding number of radial bores which are aligned with these when the insert is set in place. The radial lockout device is formed by light pistons or plungers 31 retained in these bores so as to be radially slidable therein. As best shown in FIGS. 3 to 5, each piston 31 is slidable in the bore of a retaining cylinder 32 which is threaded into a respective pair of aligned radial bores in the sleeve 23 and insert 30. The piston has a base portion 33 which engages a step 34 in the cylinder bore for retaining the piston. Under normal conditions the end of the piston 31 is flush with the end of the cylinder 32 as shown in FIG. 5 the base portion being retained by a crosspiece 35 which is affixed across the other end of the cylinder. In the case of a fault closure when gas pressure is generated within the bushing, the piston is urged radially outwardly in the manner indicated in FIG. 3.

Thus, under normal conditions, the bushing is in the close-in condition illustrated in FIG. 1, the outer ends of the pistons 31 bearing against the inner surface of the sleeve 23. In the case of a fault closure, when gas pressure is generated in response to the prestrike arc, the arc is extinguished and the snuffer/contact assembly is displaced to its second position shown in FIG. 2 as previously described. However, when the snuffer/contact assembly has been displaced, the outer end portion of the tubular sleeve 23 and the lockout pistons retained thereby project beyond the end abutment lip of the bushing housing. In this position the lockout pistons respond to the gas pressure exerted on their inner ends so as to be displaced radially outwards, as shown in FIG. 3. Thus, the pistons serve as radial abutment stops which interfere with the end abutment lip of the housing so as to prevent resetting of the snuffer/contact assembly.

Numerous variations of design within the scope of the invention are possible. As previously noted, the snuffer/contact assembly may be actuated electromagnetically rather than by gas pressure, although gas pressure will be generated in response to prestrike arcing for actuating the lockout device. Moreover, the design of the lockout device, and especially the number of radial pistons and their positioning, will be chosen to suit manufacturers' design requirements.

What we claim is:

1. For a loadbreak bushing comprising an insulating housing having an axially extending bore therein, and terminal contact means closing one end of the bore, the other end of the bore being open to receive a terminator probe, the housing having an end portion providing radial abutment means adjacent said open end of the bore:

a snuffer/contact assembly adapted to be supported within the bore for reciprocal movement therealong, the snuffer/contact assembly being axially displaceable from a first seated position to a second position in response to prestrike arcing under fault conditions, the snuffer/contact assembly comprising a tubular insulating sleeve having an inner end portion carrying a bore contact and an outer end portion adapted to cooperate with said end portion of the housing, electrically conductive means providing a current path between said bore contact and the terminal contact means, and gas-actuated radial lockout means carried by said outer end portion of the sleeve, said lockout means being responsive to the generation of gas pressure within the bore and engageable with said abutment means of the housing end portion when the snuffer/contact assembly is in the second position thereby to prevent return of the snuffer/contact assembly to the first position.

2. A snuffer/contact assembly according to claim 1, further comprising a sleeve of ablative material within said insulating sleeve, the material being adapted to generate said gas pressure in response to prestrike arcing under fault conditions.

3. A snuffer/contact assembly according to claim 2, wherein the radial lockout means comprise at least one piston located in a radial bore of said outer end portion of the tubular sleeve, the piston being displaceable radially outwardly in response to said generation of gas pressure and being positioned to interfere with said abutment means when the snuffer/contact assembly is in said second position.

4. A loadbreak bushing comprising:

an insulating housing having an axially extending bore therein, terminal contact means closing one end of the bore, the other end of the bore being open to receive a terminator probe, the housing having an end portion providing radial abutment means adjacent said open end of the bore, a snuffer/contact assembly supported within the bore for reciprocal movement therealong, the snuffer/- contact assembly being axially displaceable from a first, seated position to a second position in response to prestrike arcing under fault conditions, the snuffer/contact assembly comprising a tubular insulating sleeve having an inner end portion carrying a bore contact and an outer end portion cooperating with said end portion of the housing, electrically conductive means providing a current path between said bore contact and the terminal contact means, and gas-actuated radial lockout means carried by said outer end portion of the sleeve, said lockout means being responsive to the generation of gas pressure within the bore and engageable with said abutment means of the housing end portion when the snuffer/contact assembly is in the second position thereby to prevent return of the snuffer/contact assembly to the first position.

5. A loadbreak bushing according to claim 4, further comprising a sleeve of ablative material within said insulating sleeve, the material being adapted to generate said gas pressure in response to prestrike arcing under fault conditions.

6. A loadbreak bushing according to claim 5, wherein the radial lockout means comprise at least one piston located in a radial bore of said outer end portion of the tubular sleeve, the piston being displaceable radially outwardly in response to said generation of gas pressure and being positioned to interfere with said abutment means when the snuffer/contact assembly is in said second position.

7. A loadbreak bushing according to claim 6, wherein said abutment means are constituted by an annular lip at the end of the insulating housing.

8. A loadbreak bushing according to claim 7, wherein the piston is slidable within and retained by a retaining cylinder located within said radial bore.

9. A loadbreak bushing according to claim 8, further comprising a tubular insert threaded into the outer end portion of the insulating sleeve, the insert having a radial bore aligned with said radial bore of the sleeve and said retaining cylinder being located and retained by said pair of radially aligned bores.

10. A loadbreak bushing according to claim 6, wherein the bore contact provides a tulip contact adapted to receive the terminator probe and further defines an end face in opposed spaced relation to said terminal contact means.

11. A loadbreak bushing according to claim 10, wherein the electrically conductive means comprises a conductive cylinder lining said housing bore adjacent its closed end, the bore contact being slidable within said conductive cylinder in conductive relation thereto.

12. A loadbreak bushing according to claim 11, wherein the electrically conductive means further comprises a coiled flexible conductor between said end face of the bore contact and the terminal contact means.

13. A loadbreak bushing according to claim 12, further comprising an insulating sleeve lining the bore of the housing, the sleeve of the snuffer/contact assembly being slidable within said lining.

14. A gas-actuated loadbreak bushing comprising:

an insulating housing having an axially extending bore therein, terminal contact means closing one end of the bore, the other end of the bore being open to receive a terminator probe, the housing having an end portion providing an annular abutment lip at said open end of the bore, a snuffer/contact assembly supported within the bore for reciprocal movement therealong, the snuffer/contact assembly being axially displaceable from a first, seated position to a second position in response to the generation of gas pressure within the bore by prestrike arcing under fault conditions, the snuffer/contact assembly comprising a tubular insulating sleeve having an inner end portion carrying a bore contact and an outer end portion cooperating with said end portion of the housing, electrically conductive means providing a current path between said bore contact and the terminal contact means, a sleeve of ablative material with said insulating sleeve, the material being adapted to generate said gas pressure in response to prestrike arcing under fault conditions, and one or more pistons located in respective radial bores of said outer end portion of the tubular sleeve, the pistons being displaceable radially outwardly in response to said generation of gas pressure and being positioned to interfere with said annular abutment lip of the housing when the snuffer/contact assembly is in the second position thereby to prevent return of the snuffer/contact assembly to the first position.

* * * * *